US006115983A

United States Patent [19]

Poignard

[11] Patent Number: 6,115,983

[45] Date of Patent: Sep. 12, 2000

[54] BLOCK ASSEMBLY AND WALL CONSTRUCTED THEREFROM

[75] Inventor: John Poignard, Woodstown, N.J.

[73] Assignee: E. P. Henry Corporation, Woodbury, N.J.

[21] Appl. No.: 09/231,420

[22] Filed: Jan. 14, 1999

[51] Int. Cl.[7] ..... E04C 2/04

[52] U.S. Cl. ..... 52/606; 52/568; 52/582.2; 52/585.1; 404/40; 405/286; 405/16

[58] Field of Search ..... 52/604, 606, 608, 52/609, 442, 564, 565, 568, 426, 428, 562.1, 582.2, 585.1; 404/40, 41; 405/16, 262, 286, 284

[56] References Cited

U.S. PATENT DOCUMENTS

| | | | |
|---|---|---|---|
| 822,559 | 6/1906 | Stidder . | |
| 872,111 | 11/1907 | Dow . | |
| 952,305 | 3/1910 | Buskirk . | |
| 1,127,058 | 2/1915 | Marshall . | |
| 2,261,510 | 11/1941 | Atcheson . | |
| 4,696,140 | 9/1987 | Marshall . | |
| 4,997,316 | 3/1991 | Rose | 405/284 |
| 5,044,834 | 9/1991 | Janopaul, Jr. | 405/284 |
| 5,161,918 | 11/1992 | Hodel | 405/286 |
| 5,501,050 | 3/1996 | Ruel . | |
| 5,688,078 | 11/1997 | Hammer | 405/286 |
| 5,704,180 | 1/1998 | Boeck . | |
| 5,735,643 | 4/1998 | Castonguay et al. | 405/286 |
| 6,024,517 | 2/2000 | Castonguay et al. | 405/286 |

*Primary Examiner*—Carl D. Friedman
*Assistant Examiner*—Yvonne M. Horten
*Attorney, Agent, or Firm*—McCormick, Paulding & Huber LLP

[57] ABSTRACT

A block assembly and wall system wherein a block of masonry, or other material is provided with a vertical through opening having an enlarged and offset lower portion and a smaller upper portion. An interlock element has an enlarged offset upper portion and a smaller lower portion to provide for insertion of the latter into the upper portion of a block opening. The upper portion of the element is entered into the lower portion of an adjacent block placed atop the first block. The blocks are thus secured in position horizontally and, alternatively, the blocks may be secured vertically or in a "battered" wall construction. That is, with the connecting elements in a first attitude, a conventional vertical wall is provided whereas a 180° (one hundred eighty degrees) rotation of the elements about their vertical axis results in a "battered" wall.

17 Claims, 1 Drawing Sheet

BLOCK ASSEMBLY AND WALL CONSTRUCTED THEREFROM

BACKGROUND OF THE INVENTION

Architectural and landscaping walls have long been constructed from masonry blocks, blocks of other manufactured or blended material and blocks of material found in nature. Both mortar type walls and mortarless or "dry" walls have been employed successfully in such applications. In the case of mortarless or "dry" walls, various connecting means have been employed in order to secure blocks in position and have been generally acceptable but not wholly satisfactory in all respects.

More particularly, a simple connecting block means which may be manufactured at economic advantage and which may also be easily and effectively installed in a wall on site, has been found lacking. Further, flexibility in the construction of both conventional or vertical walls and slightly upwardly and rearwardly inclined or "battered" dry walls has been found lacking.

It is the general object of the present invention to provide a block assembly and a wall construction employing the block assembly which is extremely simple in concept and yet highly effective in the construction of both vertical and "battered" walls.

SUMMARY OF THE INVENTION

In fulfillment of the foregoing object and in accordance with the present invention, a plurality of similar unitary monolithic blocks are provided for use in substantially vertically stacked horizontally extending rows in the construction of walls and the like. Each block has a longitudinal and generally vertically extending front surface of a generally rectangular configuration viewed laterally. A pair or generally vertically extending generally rectangular and laterally rearwardly extending left and right hand end surfaces are spaced longitudinally from each other and connected with opposite ends of the front surface. A longitudinally and generally vertically extending rear surface of generally rectangular configuration viewed laterally is also connected at opposite ends with said end surfaces. Generally longitudinally and horizontally extending generally planar top and bottom surfaces of generally rectangular configuration are disposed in parallel relationship with each other and are connected at opposite ends with the end surfaces and at opposite sides with the front and rear surfaces of the block.

Further in accordance with the invention, each block is provided with a vertically extending through opening which is divided into upper and lower sections, each upper section being reduced in cross-section relative to each lower section. A plurality of small lateral connecting or interlock elements for securing the blocks in relatively fixed position laterally are disposed respectively in the openings of the block units when the blocks are stacked vertically in an assembled wall or the like. Each interlock element has an upper and lower portion with the lower portion reduced in cross section relative to the upper portion. Each lower opening section and upper interlock element are shaped so that blocks in vertically adjacent relationship reside in vertical alignment when an interlock element is positioned in a first attitude with its upper portion inserted in the lower portion of the opening of the upper block and with its lower portion entered in the upper section of the opening of the lower block. Further, the shape of each opening section and the interlock elements accommodate 180° (one hundred eighty degrees) rotation of an interlock element about its vertical axis, whereupon the shape of the element and the through opening in the upper block cooperatively serve to displace the upper and lower blocks relatively in a horizontal direction with the upper blocks being positioned incrementally rearwardly and thus cooperating with other blocks in providing a "battered" wall.

More specifically, each vertical through opening in each block is generally rectangular in cross section with its lower section offset from the vertical in one direction and each interlock element is also generally rectangular in cross section and has an upper portion offset from the vertical in one direction. The direction of the offsets for the openings and the elements are the same with the elements positioned for vertical alignment of adjacent upper and lower blocks. When upper and lower blocks are employed in a "battered" wall, the direction of offset of the elements is reversed so that each element has an offset which is opposite that of its associated opening, the elements being rotated through 180° (one hundred eighty degrees) about their vertical axis. Thus, and as will be seen, a "battered" wall is readily and conveniently provided with a minimum of effort by the installer. Still more specifically, the lower end sections of the through openings and the upper end portions of the interlock elements are preferably offset forwardly and toward the aforesaid front surface of the blocks when the elements are positioned for vertical alignment of the blocks. Thus, the opening offsets remain in the forward direction with the offsets of the elements reversed through 180° (one hundred eighty degrees) in a "battered" wall.

DESCRIPTION OF THE PREFERRED EMBODIMENT

Figure 1:
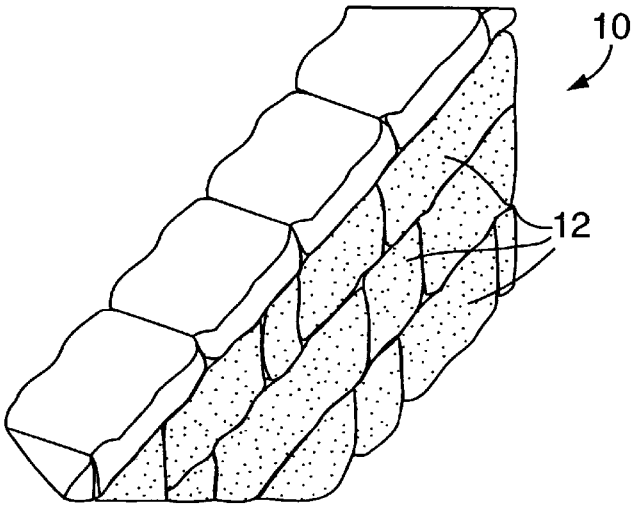
FIG. 1 is a perspective external view of a section of a wall constructed with block assemblies of the present invention.

Referring now particularly to FIG. 1, it will be noted that the blocks illustrated form a three tier or horizontal wall 10 with a row of cap units along the top. The length of the blocks 12, 12 varies substantially although this is of course optional. The blocks shown are of precast concrete but as indicated above various other types of blocks may be employed. The front surfaces of the blocks shown in FIG. 1 are provided with a natural look as for example, that of a quarried natural material, but again the invention is not so limited.

Figure 2:
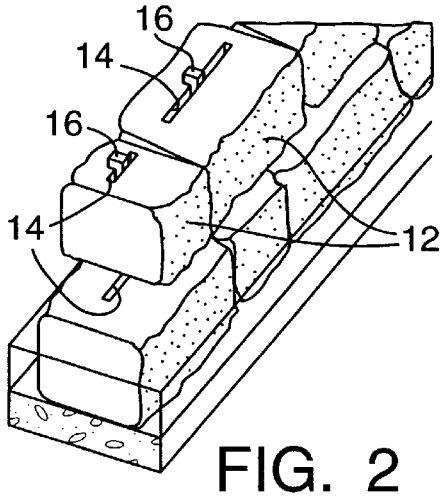
FIG. 2 is a further perspective view but showing a portion of the wall internally in order to present the interrelationship of the blocks and the interlock or connecting elements.

FIG. 2 illustrates the wall of FIG. 1 with the uppermost row of blocks 12, 12 together with certain of the blocks in the second row removed. Connecting means for the blocks is thus illustrated and it will be seen that the blocks 12, 12, although varying in length, each have a longitudinal and generally vertically extending front surface of generally rectangular configuration. The opposite end surfaces of the blocks extend laterally rearwardly and as shown in parallel relationship for connection with the opposite ends of the front surface. Longitudinally and generally vertically rear surfaces of the block are connected at opposite ends with the end surfaces and the blocks are also provided with planar and substantially parallel top and bottom surfaces of generally rectangular configuration, the top and bottom surfaces being connected at opposite ends with the end surfaces and at opposite sides with the front and rear surfaces of the blocks. The blocks 12, 12 are of course disposed as shown in horizontally extending rows in the construction of walls such as 10, and blocks 12, 12 of varying length may be employed to provide an aesthetic appearance of the wall.

Still referring to FIG. 2, it will be seen that the blocks 12, 12 each have a narrow, vertical opening or slot 14 which opens through the upper ends thereof. The slots 14 extend throughout the height of the blocks so as to be open at both ends and there may be significant variation in the length of the slots. That is, the longer blocks 12, 12 may have longer slots 14, 14 while shorter blocks 12, 12 may be provided with relatively short slots 14, 14. This provides for an interrelationship of slots 14, 14 when blocks 12, 12 are stacked vertically, wherein there will always be slots respectively in upper and lower blocks which are positioned in vertical communication with each other. This is an important feature of the present invention.

Figure 3:
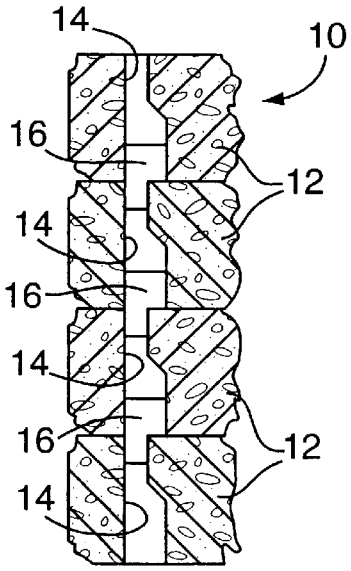
FIG. 3 is a staggered vertical section taken through each element block connection to show the manner in which a vertical wall is constructed.
Figure 4:
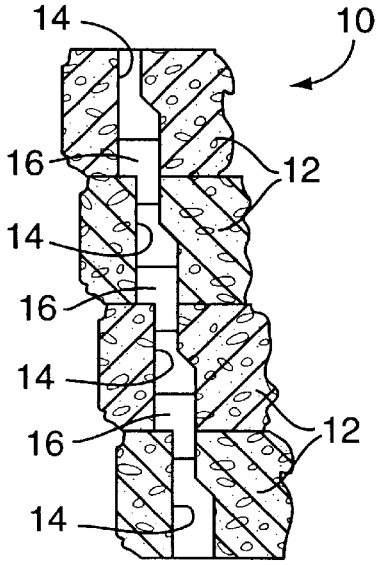
FIG. 4 is a staggered vertical section taken through each element block connection to show the manner in which a "battered" wall is constructed.

The manner in which the slots or openings 14, 14 are employed in securing the blocks laterally or horizontally is best illustrated in FIGS. 3 and 4. As will be seen, each through opening or slot 14 is provided with a relatively narrow upper section and a somewhat wider and offset lower section. Preferably and as shown, the lower sections of the slots 14, 14 are offset forwardly as shown in FIGS. 3 and 4. Considering initially the first two blocks illustrated in FIG. 3, it will be seen that the slots 14, 14 of the upper and lower blocks 12, 12 are in communication. More particularly, the forwardly offset and enlarged portion of the slot in the upper block is in communication with the narrower and upper portion of the slot 14 in the lower block. Small connecting or interlock elements 16, 16 are provided in FIG. 3 and have a lower portion which is relatively narrow and an upper portion which is somewhat wider and which is offset forwardly as illustrated in FIG. 3. Thus, the elements 16, 16 may be readily inserted as shown with their lower portions in the upper portion of the slots 14, 14 in the lowermost row of blocks in FIG. 3. The next succeeding horizontal row of blocks 12 may then be placed in position with the upper and somewhat enlarged portions of the elements 16, 16 entered in the lower portions of the slots 14, 14 thereof.

As will be apparent, a third row of blocks may thereafter be assembled on the wall employing further interlock or connecting elements 16, 16 and so forth. It is to be noted at this point that the wall shown in FIG. 3 is conventional or vertical and may be readily and quickly assembled employing the interlock or connecting elements as described.

Referring now to FIG. 4, a lowermost block 12 is provided with an interlock or connecting element 16 in a manner similar to that described above for the wall of FIG. 3. However, the interlock or connecting element 16 is rotated 180° (one hundred eighty degrees) about its vertical axis so as to provide for the rearward projection of its enlarged upper portion. Thus, the second block 12 or row of blocks 12, 12 will be offset slightly horizontally rearwardly a predetermined distance under the control of the dimensions of the interlock or connecting elements and the through openings in the blocks. Continuing, and as the wall is progressively assembled, the third row of blocks may be secured in position by interlock or connecting elements 16, 16 again reversed through 180° (one hundred eighty degrees) to provide further small incremental horizontal rearward displacements of the rows of blocks. Finally, a fourth row of blocks shown in FIG. 4 may be similarly displaced rearwardly with the result that a "battered" wall has been readily and conveniently constructed.

As will be apparent, the use of the connecting or interlock elements for a vertical and/or "battered" wall is extremely simple and readily accomplished in situ. There is no need for additional or substitute connecting elements in providing either a vertical or a "battered" wall and in either event a highly efficient wall system of substantial structural integrity results.

Figure 5:
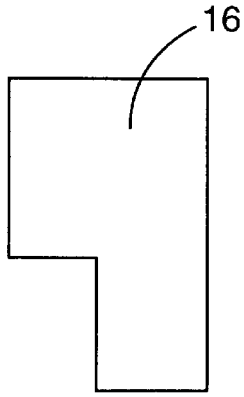
FIG. 5 is an enlarged view showing a connecting or interlock element.

FIG. 5 illustrates a preferred interlock or connecting element 16 which may be constructed of plastic or other suitable material and which can be readily produced at low cost and high volume.

As will be apparent from the foregoing, the block assembly and wall system of the present invention incorporate an extremely simple concept which is yet highly efficient in the construction of walls of high structural integrity and desirable aesthetic characteristics.

I claim:

1. A plurality of similar unitary monolithic blocks and interlock elements for use in vertically stacked horizontally extending rows in the construction of walls and the like; each block having a longitudinal and generally vertically extending front surface of a generally rectangular configuration viewed laterally, a pair of generally vertically extending generally rectangular and laterally rearwardly extending left and right hand end surfaces spaced longitudinally from each other and connected with opposite ends of said front surface, a longitudinally and generally vertically extending rear surface of generally rectangular configuration viewed laterally connected at opposite ends with said end surfaces, generally longitudinally and horizontally extending generally planar top and bottom surfaces of generally rectangular configuration disposed in parallel relationship with each other and connected at opposite ends with said end surfaces and at opposite sides with said front and rear surfaces, a vertically extending through opening in each block with upper and lower sections, each upper section being reduced in cross section relative to each lower section, and a plurality of small lateral interlock elements for securing the blocks in relatively fixed position laterally disposed respectively in said openings when the block units are stacked vertically in an assembled wall or the like, each interlock element having upper and lower portions with the lower portion reduced in cross section relative to the upper portion, and each lower opening section and upper interlock element portion being so shaped that blocks in vertically adjacent relationship reside in vertical alignment when an interlock element is positioned in a first attitude with its upper portion inserted in the lower section of the block opening of the upper block and with its lower portion entered in the upper section of the opening in the lower block, the shape of each opening section and the interlock element also accommodating a 180° rotation of the interlock element about its vertical axis whereupon the shape of the element and through opening in the upper block cooperatively serve to relatively displace the blocks horizontally with the upper block positioned incrementally rearwardly in the provision of a battered wall.

2. A plurality of blocks as set forth in claim 1, wherein each through opening is generally rectangular in cross section with its lower section offset from the vertical in one direction, and wherein each interlock element is generally rectangular in cross section and has an upper portion offset from the vertical in one direction, the direction of offset of the opening and the element being the same with the elements positioned for vertical alignment of the blocks, and the direction of offset of the elements being opposite that of the openings when the elements are rotated through 180° and positioned to vertically displace adjacent blocks in a battered wall.

3. A plurality of blocks as set forth in claim 2, wherein both the lower end section of the through openings and the upper end portion of the interlock elements are offset forwardly and toward the aforesaid front surface of the blocks when the elements are positioned for vertical alignment of the blocks, and wherein the opening offsets remain in the forward direction with the offset of the elements reversed through 180° in a battered wall.

4. A plurality of blocks as set forth in claim 3, wherein both the through openings and the interlock elements are of a generally L-shaped configuration.

5. A plurality of blocks as set forth in claim 4, wherein the through openings have a longitudinal dimension considerably greater than the thickness of the interlock elements.

6. A plurality of blocks as set forth in claim 1 wherein the front surface of each block is generally planar.

7. A plurality of blocks as set forth in claim 1, wherein the left and right hard end surfaces are generally planar.

8. A plurality of blocks as set forth in claim 1, wherein the rear surface of each block is generally planar.

9. A unitary monolithic block and interlock assembly for use with other similar block assemblies in vertically stacked horizontally extending rows in the construction of walls and the like; the block having a longitudinal and generally vertically extending front surface of a generally rectangular configuration viewed laterally, a pair of generally vertically extending generally rectangular and laterally rearwardly extending left and right hand end surfaces spaced longitudinally from each other and connected at their front ends respectively with opposite ends of said front surface, a longitudinally and generally vertically extending rear surface of generally rectangular configuration viewed laterally connected at opposite ends respectively with rear ends of said end surfaces, generally longitudinally and horizontally extending generally planar top and bottom surfaces of generally rectangular configuration disposed in at least approximate parallel relationship with each other, said surfaces being connected at opposite ends with said end surfaces and at opposite sides with said front and rear surfaces, a vertically extending through opening in each block with upper and lower sections one of which is reduced in cross section relative to the other, and a small lateral interlock element for securing vertically adjacent blocks in relatively fixed position laterally when the blocks are stacked vertically in an assembled wall or the like, the interlock element having upper and lower portions one of which is reduced in cross section relative to the other, and each larger opening section and larger interlock element portion being so shaped that blocks in vertically adjacent relationship reside in vertical alignment when an interlock element is positioned in a first attitude with its larger portion inserted in the larger section of the opening in the vertically adjacent block and with its smaller portion entered in the smaller section of the opening in the other vertically adjacent block, the shape of each larger opening section and interlock element also accommodating a 180° rotation of the interlock element about its vertical axis whereupon the shape of the element and the through opening in the adjacent block cooperatively serve to relatively displace the blocks horizontally with the upper block positioned incrementally rearwardly in the provision of a battered wall.

10. A block and interlock assembly as set forth in claim 9, wherein the through opening is generally rectangular in cross section with its said other section offset from the vertical in one direction, and wherein each interlock element is generally rectangular in cross section and has its other portion offset from the vertical in one direction, the direction of offset of the opening and the element being the same with the element positioned for vertical alignment of vertically adjacent blocks, and the direction of offset of the element being opposite that of the opening when the element is rotated through 180° and positioned to vertically displace adjacent blocks in a battered wall.

11. A block and interlock assembly as set forth in claim 10, wherein both the other end section of the through opening and the other end portion of the interlock element are offset forwardly and toward the aforesaid front surface of the blocks when the element is positioned for vertical alignment of the blocks, and wherein the opening offset remains in the forward direction with the offset of the element reversed through 180° in a battered wall.

12. A block and interlock assembly as set forth in claim 11, wherein both the through opening and the interlock element are of a generally L-shaped configuration.

13. A block and interlock assembly as set forth in claim 12, wherein the through opening has a longitudinal dimension considerably greater than the thickness of the interlock element.

14. A block and interlock assembly as set forth in claim 9, wherein the front surface of the block is generally planar.

15. A block and interlock assembly as set forth in claim 9, wherein the left and right hand end surfaces of the block are generally planar.

16. A block and interlock assembly as set forth in claim 9, wherein the rear surface of the block is generally planar.

17. A block and interlock assembly as set forth in claim 9, wherein said one section of the through opening is the upper section, and wherein said one portion of the interlock element is the lower portion.

* * * * *